US005328392A

United States Patent [19]

Lin et al.

[11] Patent Number: 5,328,392

[45] Date of Patent: Jul. 12, 1994

[54] FUSE CLIP ASSEMBLY

[76] Inventors: Kuang-Ts'an Lin; Shih-Tzung Liang, both of No. 253, Yeou Herng Street, Taoyuan City, Taiwan

[21] Appl. No.: 24,958

[22] Filed: Mar. 2, 1993

[51] Int. Cl.[5] ..... H01R 13/00

[52] U.S. Cl. ..... 439/833

[58] Field of Search ..... 439/830-833

[56] References Cited

U.S. PATENT DOCUMENTS

| | | | |
|---|---|---|---|
| 2,011,391 | 8/1935 | Bennett | 439/833 |
| 4,801,278 | 1/1989 | Sappington | 439/830 |
| 4,950,195 | 8/1990 | Perreault | 439/830 |

*Primary Examiner*—Joseph H. McGlynn

*Attorney, Agent, or Firm*—Morton J. Rosenberg; David I. Klein

[57] ABSTRACT

The junction box assembly includes a housing having a base member and a cover member, a plurality of retaining members formed on an upper surface of the base member, and a plurality of elastic fuse clips mounted in respective retaining members. Each fuse clip is provided with a pair of opposing clamping portions which releasably and grippingly receive a prong of a fuse. The sidewalls of the retaining members limit the elastic deformation of the clamping portions.

1 Claim, 3 Drawing Sheets

FUSE CLIP ASSEMBLY

BACKGROUND OF THE INVENTION

1. Field of the Invention

This invention relates to a junction box assembly. In particular, this invention pertains to a junction box assembly having a plurality of elastic fuse clips mounted in respective, substantially inelastic retaining members. Each fuse clip is provided with a pair of opposing clamping portions which releasably and grippingly receives a prong of a fuse. The sidewalls of the retaining members limit the elastic deformation of the clamping portions, thereby substantially eliminating the likelihood that the fuse clip will undergo any permanent deformation or fatigue and increasing the lifetime of the fuse clip.

2. Prior Art

A conventional or prior art fuse clip A for a junction box is shown in FIG. 1. The prior art fuse clip A includes a base A1, side walls extending upwardly from one end of base A1, and clamping walls extending inwardly from the side walls to form a clamping portion A2 which receives the prong of a fuse. The conventional fuse clip is mounted within a junction box without means to restrict the elastic deformation of the fuse clip when a fuse is inserted into the junction box. After a fuse has been inserted into and removed from the junction box a number of times, the clamping portions A2 will fatigue and lose their elasticity. Thus, after normal use of the junction box, the prongs of a fuse cannot be firmly retained between the clamping portions A2 of the junction box.

SUMMARY OF THE INVENTION

In view of the previously described disadvantage of the prior art, the present invention concept provides a junction box for receiving and securely retaining the prongs of a junction box throughout an extended working life.

It is an object of the present invention to mitigate and/or obviate the above-mentioned drawbacks of prior art junction boxes in a manner set forth in the Description of the Preferred Embodiment.

A primary object of the present invention is to provide a junction box with a plurality of retaining members adapted to receive therein a plurality of fuse clips for releasably and grippingly receiving the prongs of a fuse.

Another object of the present invention is to provide a fuse clip having a structure which facilitates insertion of a fuse into the junction box.

Further objects and advantages of the present invention will become apparent as the following description proceeds, and features of novelty are characterized in the claims annexed to and forming a part of this invention.

DESCRIPTION OF THE PREFERRED EMBODIMENT

Figure 1:
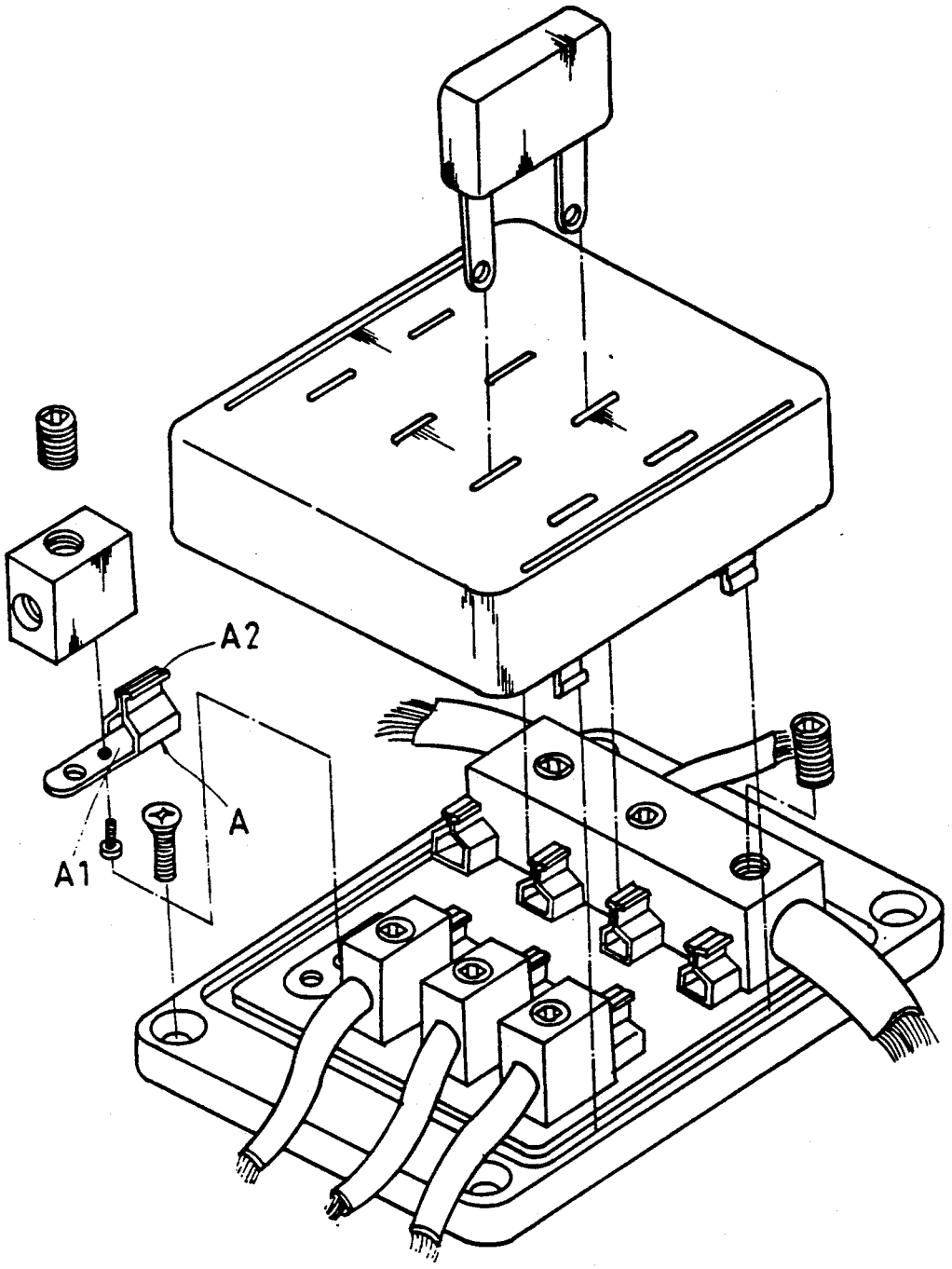
FIG. 1 is an exploded perspective view of a prior art junction box.
Figure 2:
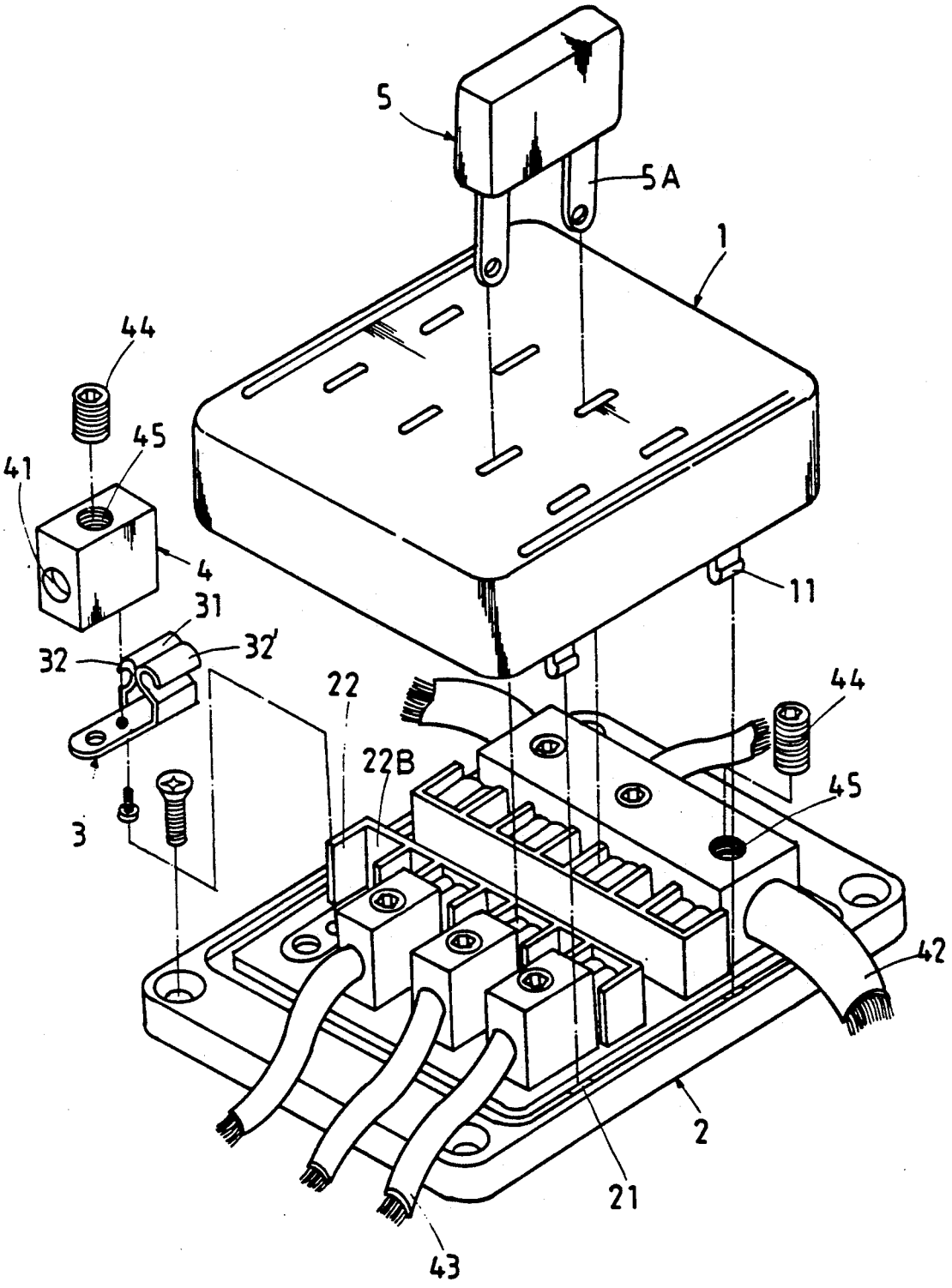
FIG. 2 is an exploded perspective view of a junction box in accordance with the present invention.
Figure 3A:
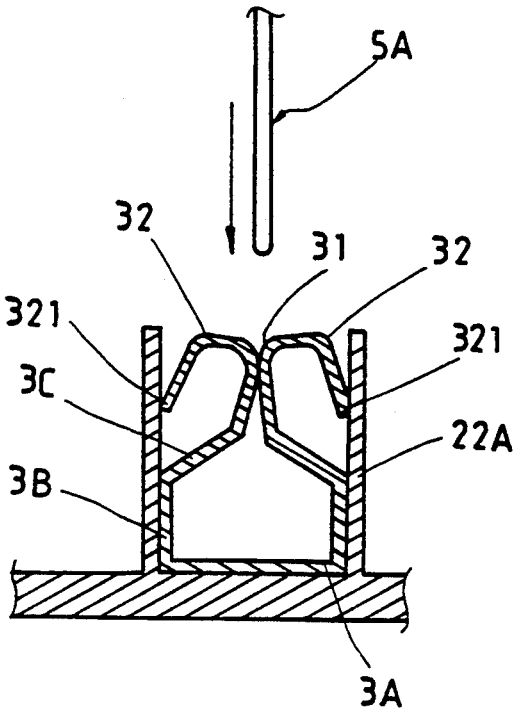
FIG. 3A is a cross-sectional view of the fuse clip and the retaining member of the present invention; and, FIG. 3B is a cross-sectional view of a prong of a fuse received in the fuse clip of the present invention.
Figure 3B:
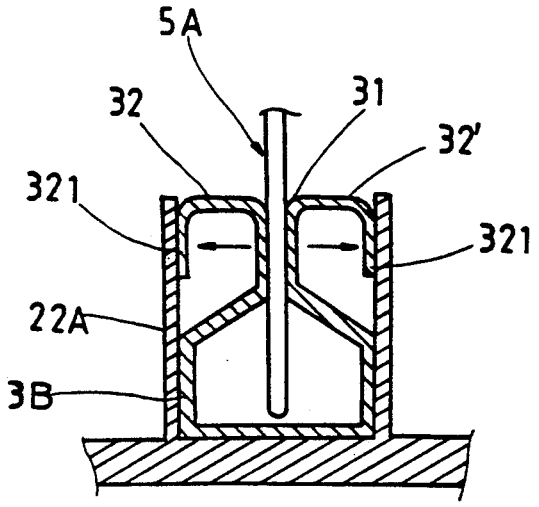

Referring to FIGS. 2–3B, there is shown a junction box of the present invention having a housing, and a plurality of fuse clips 3 mounted in the housing. The housing includes a cover member 1 having a plurality of prongs 11 extending downwardly from a side wall thereof, and a base member 2 having a plurality of slots 21 formed therein. The slots 21 are adapted to receive the prongs 11 for connecting the cover member 1 to the base member 2. The base member 2 is provided with a plurality of retaining members 22 on an upper surface thereof. Each retaining member 22 comprises a pair of substantially parallel, spaced apart sidewalls 22A extending upwardly from the upper surface of the base member 2, and a rear wall 22B extending upwardly from the upper surface of the base member 2 and connecting to the rear ends of the sidewalls 22A. A fuse clip 3 is mounted within each retaining member 22. The fuse clip 3 is formed of a relatively stiff but elastically deformable material composition. The retaining member 22 is formed of a plastic material which is less elastic than the material used to form the fuse clip 3.

Each fuse clip 3 comprises an elongated base portion 3A, and a pair of substantially parallel, spaced apart, side walls 3B extending upwardly from respective sides of one end of the base portion 3A. A pair of upper walls 3C extend inwardly from upper ends of the side walls 3B, and clamping portions 32 and 32′ are affixed to respective upper ends of the upper walls 3C. The clamping portions 32 and 32′ have a substantially U-shaped cross-section. The clamping portions 32 and 32′ are attached to the upper walls 3C in order that the open ends of the clamping portions 32 and 32′ are inverted and are directed downwardly and substantially outwardly toward the sidewalls 22A of the retaining member 22. The clamping portions 32 and 32′ abut the positional location shown at 31 to form a spring-like mechanism.

A fixing block 4 is mounted to each fuse clip 3. Each fixing block is provided with openings 41 to receive input and output cables 42 and 43. The input and output cables 42 and 43 are secured to the fixing blocks 4 by a threaded bolt 44 which threadably engages the opening 45 formed in the fixing block 4 and clamps the cables 42 and 43 therein.

As shown in FIG. 3A, the free ends 321 and 321′ of the clamping portions 32 and 32′, respectively abut the side walls 22A of the retaining member 22. The retaining member 22 is made of a PC plastic, which has a relatively low modulus of elasticity. When the prong 5A of a fuse 5 is pushed past the abutment point 31 and between the clamping portions 32 and 32′, as shown in FIG. 3B, the outer walls of the clamping portions 32 and 32′ are pushed outwardly to be in face-to-face relationship with the inner surface of the side walls 22A of the retaining member 22. The side walls 22A of the retaining member 22 limit the elastic deformation of the clamping portions 32 and 32′, thereby substantially eliminating the likelihood that the fuse clip 3 will undergo any permanent deformation or fatigue and thus increases the working or operational lifetime of the fuse clip 3. Each time a fuse 5 is inserted into the junction box, the prong 5A of the fuse 5 will be releasably and grippingly received by the fuse clip 3.

The U-shaped cross-section of the clamping portions 32 and 32′ facilitates the insertion of a prong 5A of a fuse 5 past the abutment point 31 and between the clamping portions 32 and 32' into the fuse clip 3.

Although the present invention has been described in connection with the preferred embodiment thereof, many of the variations and modifications will now become apparent to those skilled in the art without departing from the scope of the invention. It is preferred therefore that the present invention not be limited by the specific disclosure herein, but only the appended Claims.

What is claimed is:

1. A junction box assembly comprising:

a housing having a base member and a cover member adapted to attach to said base member;

a plurality of retaining members affixed to an upper surface of said base member, each said retaining member comprising a pair of substantially parallel, spaced apart sidewalls extending upwardly from said base member and a rear wall extending upwardly from said base member and connecting said pair of sidewalls;

a plurality of fuse clips mounted in respective retaining members of said base member, each said fuse flip having a pair of clamping portions in opposed relationship to releasably and grippingly receive a prong of a fuse; and, a plurality of fixing blocks mounted to a respective one of said fuse flips, each said fixing block having a first opening for receiving a conductor cable therein, and a second threaded opening for receiving a bolt therein for securing said conductor cable in said fixing block, whereby said first pair of sidewalls of said retaining members limit an elastic deformation of said clamping portions of said fuse clips when said fuse is inserted into said junction box.

* * * * *